US009500050B2

(12) United States Patent
Russell

(10) Patent No.: US 9,500,050 B2
(45) Date of Patent: Nov. 22, 2016

(54) DRILLSTRING COMBINATION PRESSURE REDUCING AND SIGNALING VALVE

(71) Applicant: Larry Rayner Russell, Houston, TX (US)

(72) Inventor: Larry Rayner Russell, Houston, TX (US)

( * ) Notice: Subject to any disclaimer, the term of this patent is extended or adjusted under 35 U.S.C. 154(b) by 394 days.

(21) Appl. No.: 14/179,193

(22) Filed: Feb. 12, 2014

(65) Prior Publication Data

US 2014/0160891 A1 Jun. 12, 2014

Related U.S. Application Data

(63) Continuation-in-part of application No. 14/080,271, filed on Nov. 14, 2013, now abandoned.

(60) Provisional application No. 61/796,806, filed on Nov. 20, 2012.

(51) Int. Cl.

| | |
|---|---|
| ***E21B 47/18*** | (2012.01) |
| ***G01V 3/00*** | (2006.01) |
| ***E21B 33/00*** | (2006.01) |
| ***E21B 34/00*** | (2006.01) |
| ***E21B 34/06*** | (2006.01) |
| ***E21B 21/00*** | (2006.01) |
| ***E21B 21/08*** | (2006.01) |
| ***E21B 21/10*** | (2006.01) |

(52) U.S. Cl.
CPC ..... *E21B 21/001* (2013.01); *E21B 21/08* (2013.01); *E21B 21/10* (2013.01)

(58) Field of Classification Search
USPC ..... 137/613; 367/81–85; 340/853.1–856.4
See application file for complete search history.

(56) References Cited

U.S. PATENT DOCUMENTS

2005/0178558 A1* 8/2005 Kolle ..... E21B 47/14 166/373
2008/0029273 A1* 2/2008 Pia ..... E21B 34/102 166/373

* cited by examiner

*Primary Examiner* — Firmin Backer
*Assistant Examiner* — Jerold Murphy
(74) *Attorney, Agent, or Firm* — Elizabeth R. Hall

(57) ABSTRACT

A drillstring combination pressure reducing and signaling valve assembly uses multiple ball valves mounted in parallel, each having a different bore, to meter the flow through a drillstring. The individual ball valves are maintained in either a fully open or a fully closed position, but can be selectively moved between these two positions. The bores of the individual ball valves are sized so that at a given pressure, a first ball valve has a predetermined flow rate, a second ball valve has twice the flow rate of the first ball valve, a third ball valve has twice the flow rate of the second ball valve, and the remaining ball valves each have twice the flow rate of their predecessor in the valve sequence. This arrangement permits the flow rate and flow pressure drop through the assembly of valves to be digitally controlled by varying the combination of open and closed valves. In addition, another ball valve serving as a signaling valve is rapidly shifted either between a closed position, an open position, and back to a closed position. The signaling valve serves as a bidirectional signaling valve by relaying sensed pressure pulse signals emanating from either above or below the signaling valve past the valve assembly. Alternatively, the additional ball valve can be rapidly shifted between an initial open position to a closed position and then to a final open position. Pressure sensing is provided both above and below the valve assembly, and operative and control means are provided for the valve assembly.

17 Claims, 7 Drawing Sheets

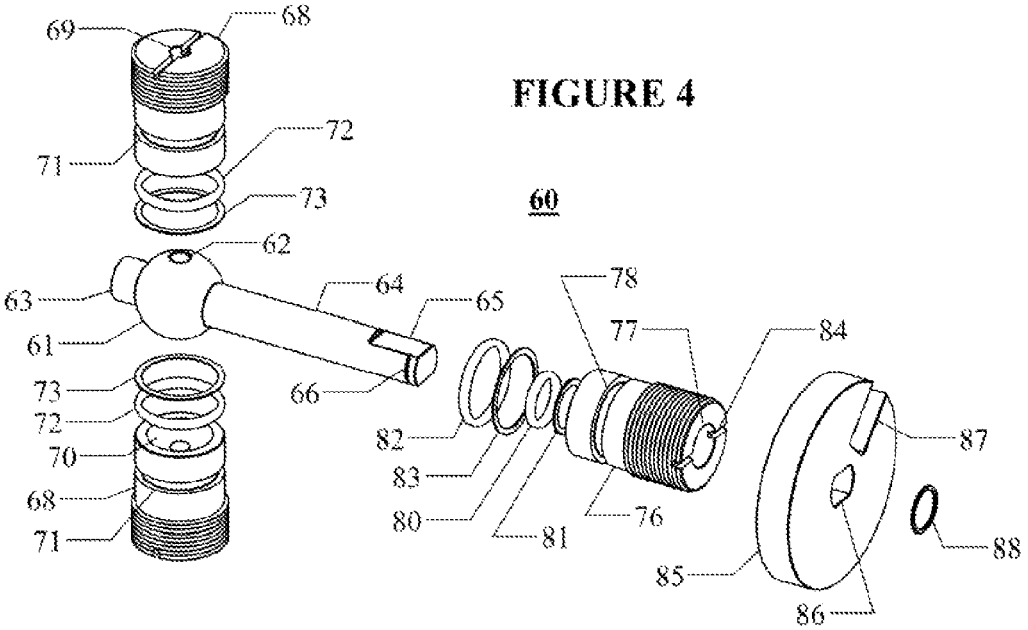
FIGURE 4
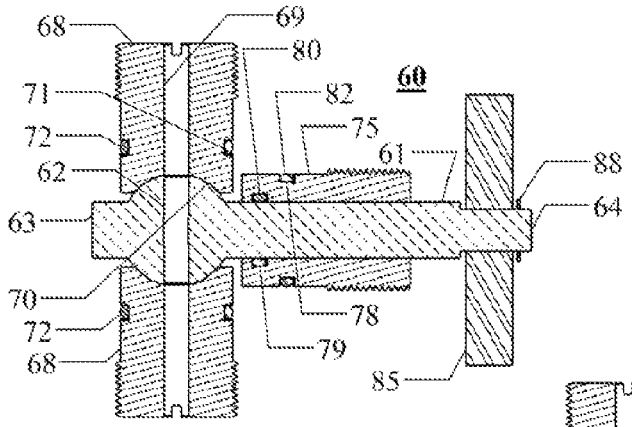
FIGURE 5
FIGURE 6
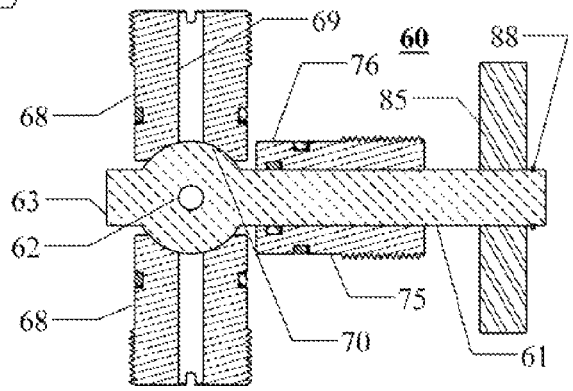

FIGURE 7
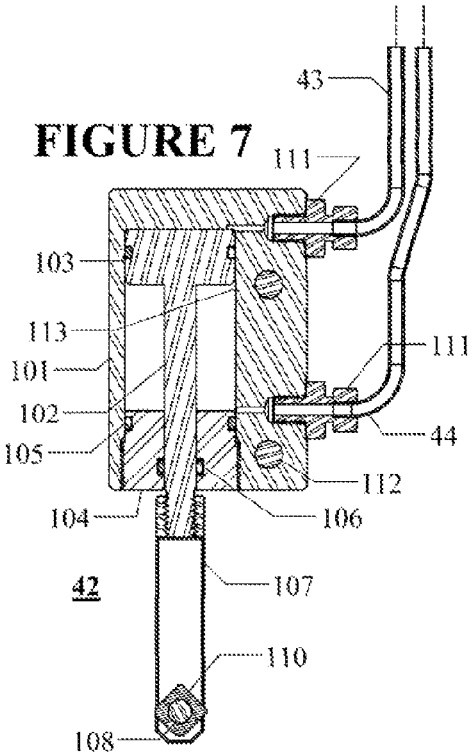
FIGURE 11
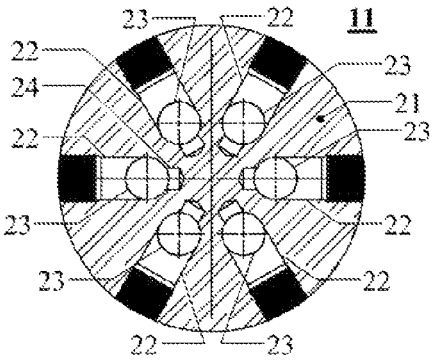
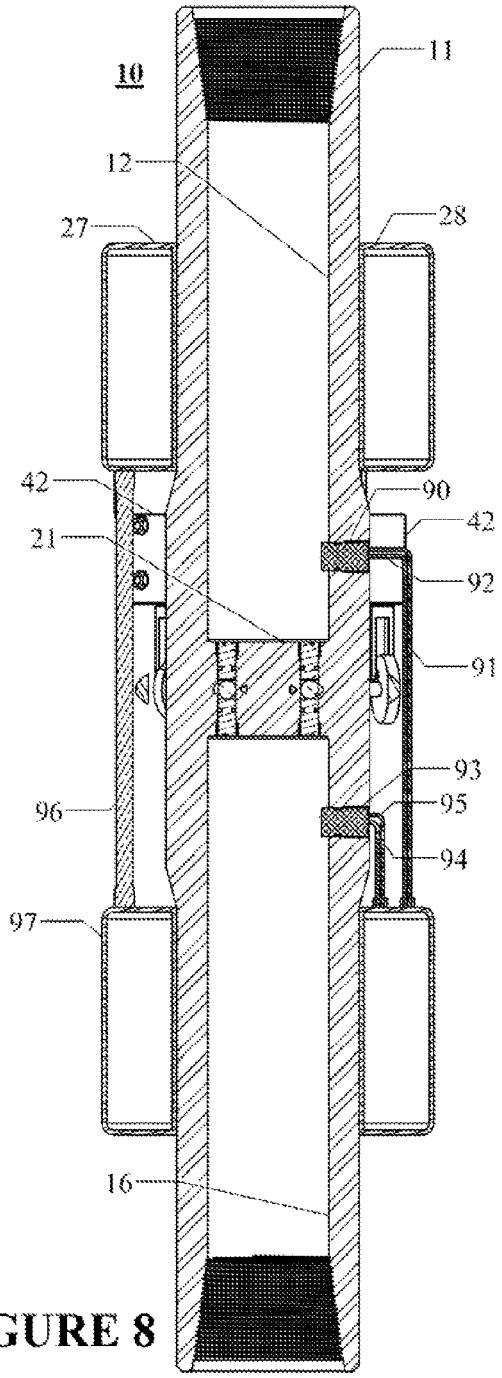
FIGURE 8

CONTROL SYSTEM FOR PRESSURE REDUCING & SIGNALING VALVE

DRILLSTRING COMBINATION PRESSURE REDUCING AND SIGNALING VALVE

CROSS REFERENCE TO RELATED APPLICATIONS

The present application is a continuation-in-part of U.S. Ser. No. 14/080,271 filed Nov. 14, 2013, entitled "Stonewall Pressure Reducing and Signaling Valve" by inventor Larry Rayner Russell, which claims the benefit under USC 119 of the filing date of provisional application Ser. No. 61/796,806 filed Nov. 20, 2012 entitled "Stonewall Pressure Reducing and Signaling Valve".

BACKGROUND OF THE INVENTION

Field of the Invention

The present invention relates in general to a drillstring combination pressure reducing and signaling valve assembly. More particularly, the invention relates to the pressure reducing and signaling valve assembly having multiple ball valves of different bore sizes used to meter the flow through the drillstring.

Description of the Related Art

Historically, petroleum drilling in deep waters has been plagued by the effects of the differential density between the downwardly flowing and returning mud columns and sea water over the depth of the sea at the well site. This differential density results in a relatively large pressure differential between the mud column and sea water at the sea bed. This large pressure differential affects not only the well casing settings required, but it may even result in an inability to reach the target depth of the well.

Various remedies for this problem have been suggested, and early trials of some approaches have been made. In one system, the returns from the well are pumped to the drilling rig at the ocean surface by a pumping arrangement close to the seabed. However, none of the current approaches have provided the needed solution to the pressure differential at the seabed caused between the down flowing mud column and the sea water.

Solutions such as using a pressure reducing valve in the drillstring have not been successfully achieved due to the abrasive nature of drilling fluids and the very high velocities of the drilling fluid. Furthermore, positioning a pressure reducing valve intermediate to the length of a drillstring would effectively negate the use of mud pulse telemetry equipment in marine drilling, as the pressure reducing valve would block the relay of pressure pulse telemetry signals from both above and below the valve.

A need exists for a pressure reduction device for use in an intermediate position in a drillstring which provides a long service life and provides a means for overcoming the blockage of mud pulse telemetry through the drillstring.

SUMMARY OF THE INVENTION

Embodiments of the present invention use a multiplicity of two position independently operable rotary ball valves, each having a different flow capacity at a given pressure, to produce a combined flow rate at a desired pressure drop. The parallel sequence of valves is arranged so that the flow capacity of the next ball valve in the sequence is double that of the preceding ball valve. A desired pressure drop for a combined flow capacity for the sequence of valves can be altered in a stepwise manner by varying the combination of open and closed valves. The maximum flow rate for the set of valves is produced with all of the valves open, while closing all of the valves completely stops any flow. The flow capacity of the valve combination depends on both the pressure capability and flow capacity of the pump supplying the system as well as the flow passages of the valves.

This approach permits adjusting the individual valve positions to obtain a binary digital variation of flow rates. Increasing the number of valves permits the flow to be regulated in smaller steps. The ball valves and their seats are made of wear resistant material in order to obtain a long service life for the system. Upstream and downstream sensors are used to provide differential pressure data to permit an electronic control system to issue appropriate control instructions to the individual actuators for each of the ball valves.

Mudpulse telemetry utilizing induced pulse like variations in drillstring pressures superimposed on the normal flow pressure is frequently used to provide bidirectional telemetry in a drillstring. However, the presence of the set of backpressure ball valves in an intermediate position in a drillstring effectively attenuates any mudpulse signals upon their passage through the pressure reducing valve assemblage of the present invention.

Whenever a two-position valve controlling a flow is rapidly operated between an initial position, its alternative position, and back to the original position, pressure pulses which are sufficiently large to serve as communication mudpulses are created. The inability of directly transmitting mudpulses past the pressure reducing valve assembly is overcome by using a rapidly cycling ball valve of this type, also called a signaling valve herein, to bidirectionally relay pressure pulse signals detected by either of a pair of pressure sensors mounted on opposed ends of the control valve. The signaling valve can either be one of the ball valves of the pressure reducing assemblage or a separate dedicated ball valve.

The drillstring combination pressure reducing and signaling valve assembly uses multiple ball valves mounted in parallel, each having a different bore, to meter the flow through a drillstring. The assembly is positioned intermediate in a tubular oilfield drillstring. The individual ball valves are maintained in either fully open or fully closed positions, but can be selectively moved between these two positions.

The bores of the individual ball valves are sized so that at a given pressure, a first ball valve has a predetermined flow rate, a second ball valve has twice the flow rate of the first ball valve, a third ball valve has twice the flow rate of the second ball valve, and the remaining ball valves each have twice the flow rate of their predecessor in the valve sequence. This arrangement permits the flow rate and flow pressure drop through the assembly of valves to be digitally controlled by varying the combination of open and closed valves.

Additionally, another ball valve serving as a signaling valve which can be rapidly shifted between a closed position, an open position, and back to a closed position can serve as a bidirectional signaling valve, relaying pressure pulse signals emanating from either above or below the signaling valve past the valve assembly. Alternatively, the additional ball valve can be rapidly shifted between an initial open position to a closed position and then to a final open position. Pressure sensing is provided both above and below the valve assembly, and control means are provided for the valve assembly.

The signaling valve can be used to relay pressure pulse telemetry signals transmitted from above the combination valve assembly to below the valve assembly. Likewise, the signaling valve can be used to relay pressure pulse signals transmitted from below the combination valve assembly to above the valve assembly.

One aspect of the present invention is a combination pressure reducing and signaling valve utilizing multiple independently controlled and operated ball valves. Another aspect of the present invention is a combination pressure reducing and signaling valve providing pressure sensors both above and below the valves for monitoring both static pressures and transitory pressures. Yet another aspect of the present invention provides the control means for sensing and adjusting the pressure drop and flow across the multiple ball valves of the system. A further aspect of the present invention uses the control system to cause temporary cycling of one of the ball valves of the assembly to produce bidirectional transitory pressure pulses in the drillstring.

One embodiment of the present invention is a drillstring valve assembly for operation in a fluid filled drillstring, including: a) a tubular body of the drillstring valve assembly having a transverse diaphragm with multiple through ports; b) a series of ball valves, wherein each ball valve is centrally mounted in a diaphragm through port and wherein each ball valve is rotationally supported by a shaft and has a flow passage bore of a different size from the other valves; c) a signaling valve centrally mounted in one diaphragm through port; d) an independent actuator for each ball valve and the signaling valve; e) a first and second pressure sensor, wherein the first and second pressure sensors are positioned on opposed sides of the diaphragm; and f) a programmable control unit, wherein the control unit communicates operating instructions to each actuator based on a set of pressure data received by the control unit from the first and second pressure sensors.

A second embodiment of the present invention is a drillstring valve assembly including: a) a tubular body of the drillstring valve assembly having a transverse diaphragm with multiple through ports, wherein the body is connected to a drillstring within a central portion of a length of the drillstring; b) a series of two position independently operable ball valves, wherein each ball valve is centrally mounted in a diaphragm through port and wherein each ball valve has a different flow capacity at a given pressure from the other valves; c) a first and second pressure sensor, wherein the first and second pressure sensors are positioned on opposed sides of the diaphragm; d) an independent signaling valve centrally mounted in one diaphragm through port, wherein a flow capacity of the signaling valve at the given pressure is greater than at least one of the ball valves and wherein the rapid opening and closing of the signaling valve produces and transmits a pressure pulse through the diaphragm; e) an actuator for each ball valve and the signaling valve; and f) a programmable control unit in communication with the first and second pressure sensors, wherein the control unit determines a pressure differential across the diaphragm and whenever that pressure differential across the diaphragm is greater than a desired pressure differential the control unit sends operating instructions to at least one actuator of one of the ball valves to open or close the ball valve.

A third embodiment of the present invention is a drillstring of valve assembly comprising: (a) a tubular body having a central transverse diaphragm, wherein the body is connected to a drillstring within a central portion along a length of the drillstring; (b) an ordered sequence of multiple actuated two position ball valves mounted in a through port in the diaphragm such that a flow passage of each valve is selectably opened or closed, wherein each valve has a different flow capacity at a given pressure drop, said flow capacities of the individual valves doubling with progression through the sequence; (c) an upper pressure sensor positioned above the diaphragm and a lower pressure sensor positioned below the diaphragm; (d) a signaling valve centrally mounted in one diaphragm through port, wherein a flow capacity of the signaling valve at the given pressure drop is greater than at least one of the ball valves and wherein the rapid opening and closing of the signaling valve produces and transmits a pressure pulse propagating bidirectionally away from the diaphragm; e) an actuator for each ball valve and the signaling valve; and f) a programmable control unit in communication with the upper and lower pressure sensors, the ball valves and the signaling valve, wherein the control unit receives all pressure measurements from the upper and lower pressure sensors, controls the opening and closing of the signaling valve, processes all pressure pulses transmitted from the diaphragm and sends operating instructions to open or close at least one of the ball valves, and g) a power source for operating the actuators of the valves.

A fourth embodiment of the present invention is a method of transmitting a pressure pulse signal including: a) maintaining a pressure differential across a diaphragm mounted transversely across a drillstring; b) sensing a pressure pulse signal on a first side of the diaphragm, and c) rapidly opening and closing a signaling valve controlling a flow passage through the diaphragm, thereby producing and transmitting an outgoing pressure pulse on the opposed side of the barrier.

The foregoing has outlined rather broadly several aspects of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed might be readily utilized as a basis for modifying or redesigning the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 4 shows an oblique exploded view of the operative components of one of the ball valves of the present invention.

FIG. 5 shows a longitudinal sectional view of the ball valve of FIG. 4, wherein the valve is in its open position.

FIG. 6 shows a longitudinal sectional view of the ball valve of FIGS. 4 and 5, wherein the valve is in its closed position.

FIG. 7 shows a longitudinal cross-sectional view of the double acting hydraulic cylinder of FIG. 3.

FIG. 8 shows a longitudinal sectional view taken through the upper and lower pressure sensors of the combination pressure reducing and signaling valve of FIG. 1.

FIG. 11 is a cross-sectional view taken transversely to the axis of the valve body.

DESCRIPTION OF THE PREFERRED EMBODIMENTS

Figure 1:
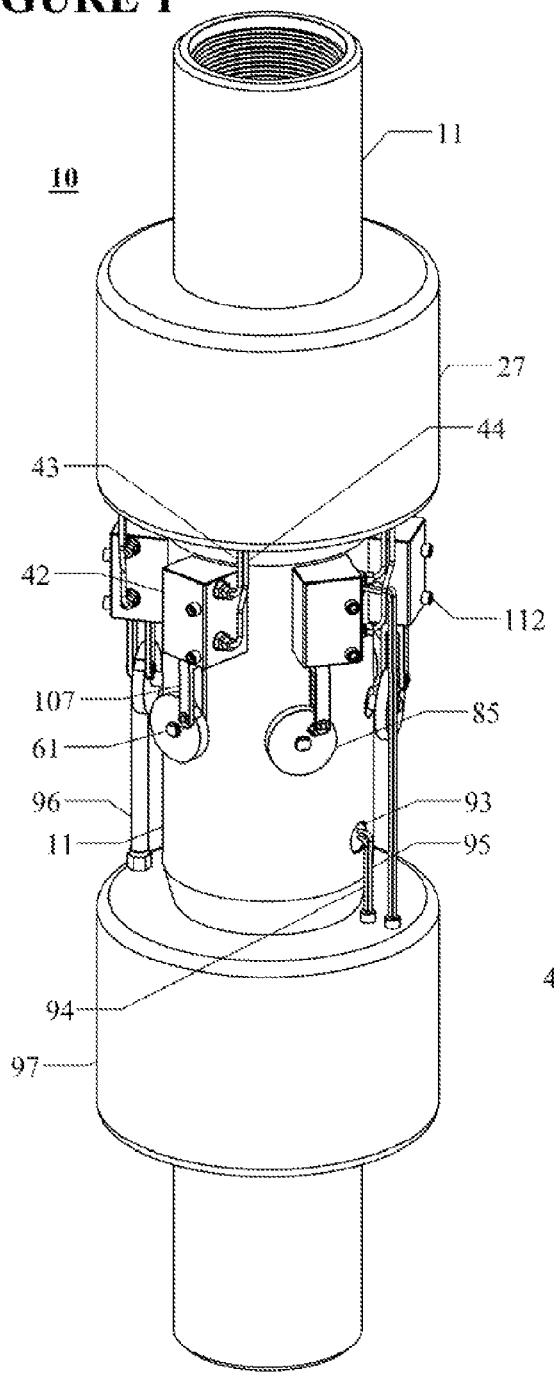
FIG. 1 shows the drillstring combination pressure reducing and signaling valve of the present invention in an oblique profile view. The combination pressure reducing and signaling valve is shown prior to its being installed intermediate to the length of a drillstring and its being entered into a well.
Figure 2:
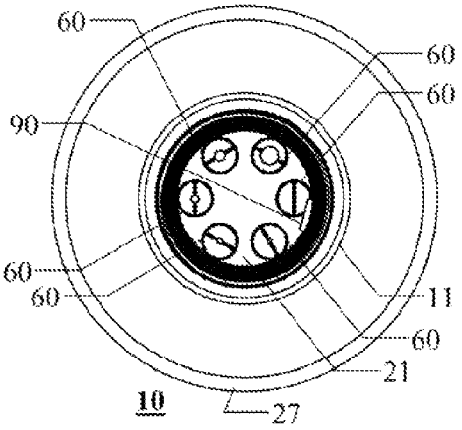
FIG. 2 shows an axial view from the upper end of the combination valve of FIG. 1.

Embodiments of the present invention include a drillstring combination pressure reducing and signaling valve assembly for mounting in the drillstring. Embodiments of the pressure reducing and signaling valve assembly described herein having multiple ball valves of different bore sizes used to meter the flow through the drillstring.

Historically, petroleum drilling in deep waters has been plagued by the effects of the differential density between the down flowing mud columns versus the up flowing sea water at well sites in deep water. This differential density typically results in a large pressure differential between the mud column and sea water at the sea bed.

One solution for reducing the seabed pressure of the down flowing mud column would be to provide a pressure reducing valve in the drillstring. This particular approach has been difficult to achieve with conventional valve arrangements due to the abrasive nature of drilling fluids and the very high velocities of the drilling fluid. Embodiments of the present invention provide an abrasive resistant control valve system for achieving the desired pressure reduction at the seabed for the down flowing drilling mud column.

In addition, mud pulse telemetry equipment is frequently used in drilling situations in which the pressure reducing function of the present invention would be desirable. However, positioning a conventional pressure reducing valve intermediate to the length of a drillstring would effectively block pressure pulse telemetry from both above and below without provision of some means of relaying the signal.

Embodiments of the present invention include a valving means for regulating the flowing pressure differential across a transverse bulkhead in a tubular body suitable for mounting in a drillstring. The valving means uses a multiplicity of two position independently operable rotary ball valves, each having a different flow capacity at a given pressure, to produce a combined flow rate at a desired pressure drop.

The parallel sequence of valves is arranged so that the flow capacity of the next ball valve in the sequence is double that of the preceding ball valve. A desired pressure drop for a combined flow capacity for the sequence of valves can be altered in a stepwise manner by varying the combination of open and closed valves. The maximum flow rate for the set of valves is produced with all of the valves open, while closing all of the valves completely stops any flow. The flow capacity of the valve combination depends on both the pressure capability and flow capacity of the pump supplying the system.

The bores of the individual ball valves are sized so that at a given pressure, a first ball valve has a predetermined flow rate, a second ball valve has twice the flow rate of the first ball valve, a third ball valve has twice the flow rate of the second ball valve, and the remaining ball valves each have twice the flow rate of their predecessor in the valve sequence. This arrangement permits the flow rate and flow pressure drop through the assembly of valves to be digitally controlled by varying the combination of open and closed valves.

This approach permits adjusting the individual valve positions to obtain a binary digital variation of flow rates. Increasing the number of valves permits the flow to be regulated in smaller steps. The ball valves and their seats are made of wear resistant material in order to obtain a long service life for the system. Upstream and downstream sensors are used to provide differential pressure data to permit an electronic control system to issue appropriate control instructions to the individual actuators for each of the ball valves.

Mud pulse telemetry utilizing induced pulse like variations in drillstring pressures superimposed on the normal flow pressure is frequently used to provide bidirectional telemetry in a drillstring. However, the presence of the set of backpressure ball valves in an intermediate position in a drillstring effectively attenuates any mud pulse signals upon their passage through the pressure reducing valve assemblage.

Whenever a two-position valve controlling a flow is rapidly operated between an initial position, its alternative position, and back to the original position, pressure pulses which are sufficiently large to serve as communication mud pulses are created. The inability of directly transmitting mud pulses past the pressure reducing valve assembly is overcome by using a rapidly cycling ball valve of this type to bidirectionally relay pressure pulse signals detected by either of a pair of pressure sensors mounted on opposed ends of the control valve. The ball valve can either be one of the valves of the pressure reducing assemblage or a separate dedicated signaling valve.

The addition of a separate ball valve serving as a signaling valve which can be rapidly shifted between a closed position, an open position, and back to a closed position can serve as a bidirectional signaling valve, relaying pressure pulse signals emanating from either above or below the signaling valve past the valve assembly. Alternatively, the additional ball valve can be rapidly shifted between an initial open position to a closed position and then to a final open position. Pressure sensing is provided both above and below the valve assembly, and control means are provided for the valve assembly.

The signaling valve can be used to relay pressure pulse telemetry signals transmitted from above the combination valve assembly to below the valve assembly. Likewise, the signaling valve can be used to relay pressure pulse signals transmitted from below the combination valve assembly to above the valve assembly.

Drillstring Combination Pressure Reducing and Signaling Valve Assembly

A drillstring combination pressure reducing and signaling valve assembly 10 (hereinafter also referred to as the combination valve assembly) provides a valving means for regulating the flowing pressure differential across a transverse bulkhead in a tubular body suitable for mounting in a drillstring. The valve assembly 10 includes multiple independently operable two-position rotary ball valves, each having a different flow capacity, mounted in bores penetrating the bulkhead.

Figure 9:
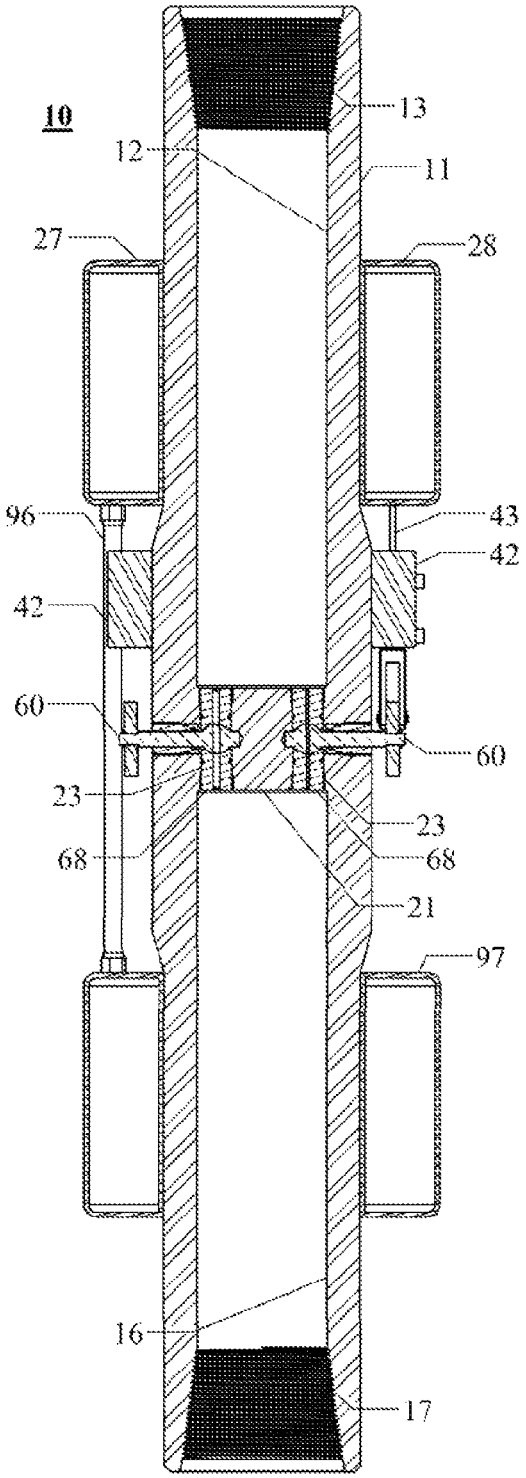
FIG. 9 shows a longitudinal sectional view taken through two of the ball valves of the combination pressure reducing and signaling valve of FIG. 1, wherein the valves are shown in their open positions.

FIGS. 1, 8, and 9 show one embodiment of the combination pressure valve assembly 10. With the exception of the ball valves and their seats, the structural components of the combination pressure reducing and signaling valve are alloy steel. The ball valves and their seats are constructed of sintered tungsten carbide.

Figure 10:
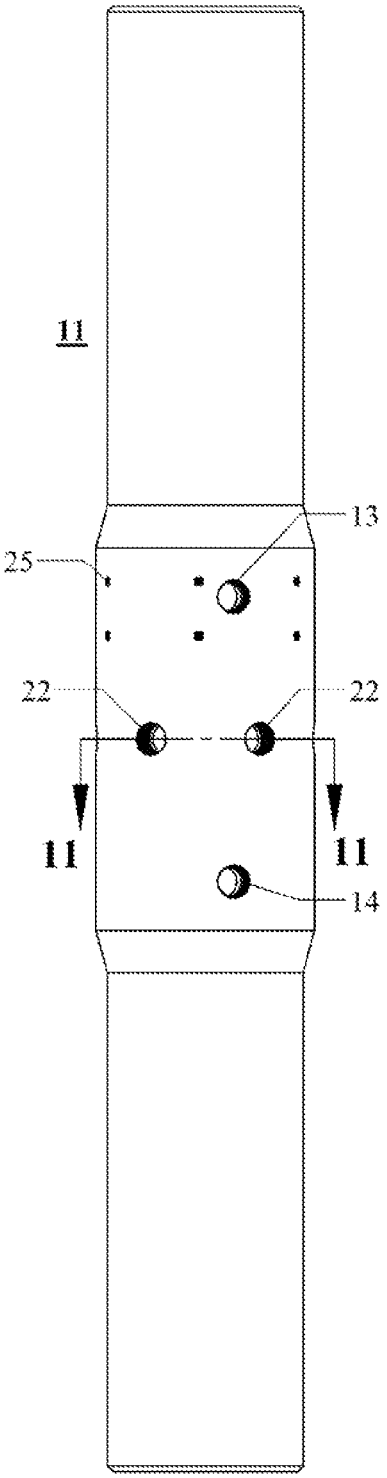
FIG. 10 is a vertical profile view of the body of the combination pressure reducing and signaling valve.

As seen in FIGS. 8, 10, and 11, a tubular body 11 having a female thread 13, 17 at both its respective upper and lower outer ends has relatively large upper 12 and lower 16 bores with a thick central transverse diaphragm 21 at the midlength of the body. The outer diameter of the body 11 is increased at its midlength, and frustroconical transition sections join the exterior of the midbody to the upper and lower ends. The threads 13, 17 are suitable for connecting the body 11 into a drillstring.

A threaded radial upper pressure sensor bore 13 penetrates the wall of body 11 into the upper bore 12. A similar threaded radial lower pressure sensor bore 14 penetrates the wall of body 11 into the lower bore 16. A regularly spaced array of pairs of drilled and tapped external radial holes 25 which do not penetrate through the body 11 are located above the transverse diaphragm to serve as valve actuator mounting holes. The number of pairs of valve actuator mounting holes 25 is equal to the number of valves which will be mounted in the body.

An equispaced array of off-axis valve seat mounting bores 23 penetrate the transverse midplane in the transverse bulkhead 21 outwardly from and parallel to the axis of the body 11. The number of valve seat mounting bores 23 is equal to the number of valves which will be installed in the body. Both outer ends of the valve seat mounting bores 23 are threaded. As shown by way of example in the drawings herein, six valves are used, but other numbers of valves may be used.

The transverse midplane of the diaphragm 21 contains a coplanar array of equispaced identical outwardly opening radial valve mounting bores 22. Each radial valve mounting bore 22 penetrates the transverse bulkhead 21 of the body to a valve seat mounting bore 23 and its bore axis intersects the axis of that valve seat mounting bore.

FIG. 11 is a cross-sectional view transverse to the axis of the body 11 of the combination valve 10. As seen there, each radial valve mounting bore 22 has from its outer end an external end female thread and an interior straight bore having the same diameter as the valve seat mounting bore 23 which it intersects. The straight bore is continued to the valve seat mounting bore 23. A short coaxial reduced diameter bore 24 extends radially inwardly from the intersection of the radial valve mounting bore 22 with the valve seat mounting bore 23.

As seen in FIGS. 1, 8, and 9, an annular housing 28 serves to hold the internal components of the hydraulics module 27. The housing 28 is sealed against ingress of fluids and pressure and is mounted coaxially with a close fit to the body 11 of the combination valve 10 at a location above the central enlarged outer diameter section of the body.

Figure 12:
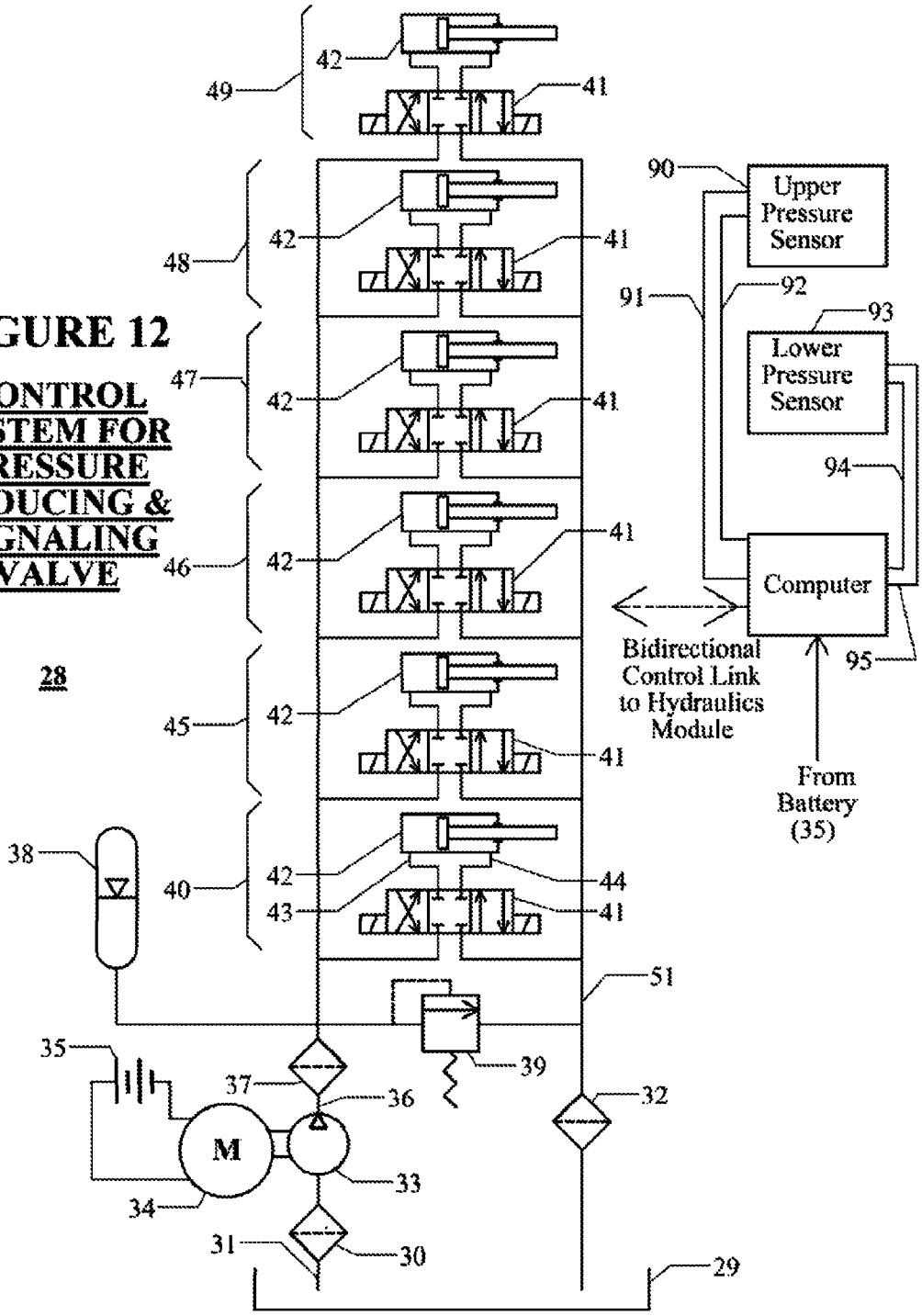
FIG. 12 is a schematic diagram describing the hydraulic system utilized to operate the individual ball valves of the combination pressure reducing and signaling valve.

FIG. 12 shows a schematic of the hydraulics module components which provide the motive forces to actuate the individual ball valves of the combination valve 10. The actual positioning of the components of the hydraulics module is not indicated in any of the drawings; a variety of possible arrangements could be used to create satisfactory circuitry, as may be understood by those skilled in the art. In the schematic, the double-acting hydraulic actuator cylinders 42 are shown closely coupled to their individual control valves in FIG. 12. However, as can be seen in FIG. 1, the cylinders 42 are external to the hydraulics module 28 and are each connected to the hydraulic circuitry in module 28 by tubular fluid connections 43 and 44.

A battery 35 provides the power to run a DC electric motor 34 which powers a hydraulic pump 33 which in turn powers the hydraulic system of the hydraulics module. A separate means for charging the battery 35 typically would be used with the combination valve, but is not shown herein. A closed reservoir 29 holds most of the volume of hydraulic fluid for the system. The reservoir 29 has a low pressure filter 30 connected to the suction line 31, which is in turn connected to the inlet of the hydraulic pump 33. The output of the hydraulic pump 33 flows through a high pressure filter 37. The flow passing through the high pressure filter 37 then flows to a four-way fitting which is connected to an accumulator 38, a high pressure relief valve 39, and an extension of the supply line 36.

The supply line 36 has parallel branches which individually supply pressurized hydraulic fluid to each of the control valve and actuator sets 40, 45, 46, 47, 48, and 49. Each control valve 41 and actuator 42 set operates one of the six ball valve assemblies 60 of the combination valve 10. Return flow from each of the control valves 41 is connected to low pressure return flow line 51. The exiting flow from the return flow line 51 passes through a low pressure filter 32 before reentering the hydraulic reservoir 29.

The individual control valves 41 are four-way three-position solenoid actuated valves. The power to actuate the solenoids of the control valves 41 is drawn from the battery 35. A combination communication and power cable 96 transfers power from battery 35 and data between the hydraulics module 28 and the control module 97. The annular control module 97 is located in a sealed annular housing around the lower end of the body 11. Although not shown herein for reasons of a clearer depiction of the arrangement of the working components of the combination valve 10, a protective annular cover will be employed to shroud the hydraulics module 27, the control module 97, and the valve actuator cylinders 42 with the external portions of the ball valves 60.

A computer or some other suitable type of electronic control device is housed in the control module 97. The electronic control device is powered by battery 35 through power cable 96. The solenoids of the control valves 41 and the speed of the motor 34 are also controlled by signals transmitted over data cable 95.

An upper pressure sensor 90 and a lower pressure sensor 93 are respectively sealingly screwed into the upper 13 and lower 14 pressure sensor bores of the body 11. The pressure sensors 90 and 93 are each powered by the battery 35 through their power cables 91 and 95, respectively. The signals from pressure sensors 90 and 93 are transmitted back to the control module 97 by their respective data cables 92 and 95.

Figure 3:
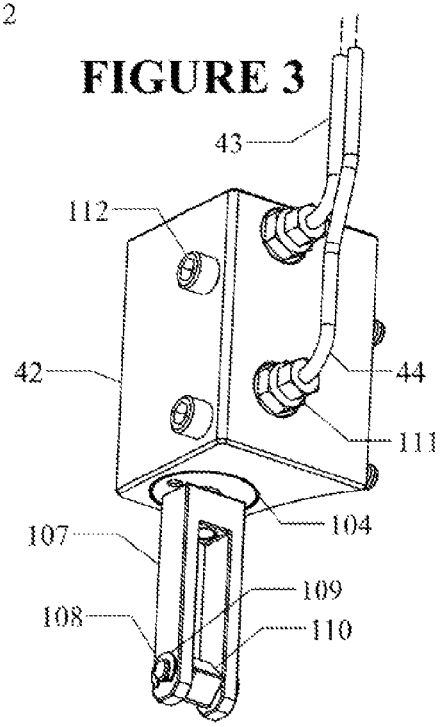
FIG. 3 shows an oblique view of a double acting hydraulic cylinder used to operate one of the ball valves of the drillstring combination pressure reducing and signaling valve.

FIGS. 3 and 7 show details of a typical double acting hydraulic cylinder assembly 42. Each hydraulic cylinder 42 actuates one of the six ball valve assemblies 60. FIG. 7 is a longitudinal cross-sectional view taken through the center of the bore of the cylinder 42 on a plane perpendicular to a radial plane through the axis of the combination valve 10 and the centerline of the bore of the cylinder 42.

Looking axially at the combination valve 10, the cylinder body 101 of cylinder 42 has a right rectangular prismatic shape except for its side adjacent to the body 11. That adjacent side is arced to have a close fit to the enlarged central portion of the body 11 of the combination valve 10. A cylindrical bore 113 having a tapped lower end extends perpendicularly upwardly from the lower end of body 101.

As seen in FIG. 7, a pair of parallel horizontal and vertically spaced apart drilled and tapped holes extend from one flat side of the body 101 of cylinder 42 to intercept the bore of the cylinder body both at the upper end of the bore 113 and a short distance upward of the lower end of the body. A tube fitting 111 is sealingly screwed into each of these horizontal holes. The upper fitting 111 is connected to a piston end hydraulic line 43 and the lower fitting 61 is connected to a rod end hydraulic line 44.

A pair of vertically spaced apart horizontal holes parallel to the opposed parallel vertical sides of the cylinder body 101 are engaged by the shanks of the mounting screws 112 which are in turn threadedly engaged in a pair of the valve actuator mounting holes 25 of the body 11 of the combination valve 10.

The piston and rod assembly 102 has a short transverse enlarged right circular cylindrical upper end with an annular O-ring groove centrally located on its outer cylindrical surface. This enlarged portion of the piston and rod assembly 102 serves as a piston head. O-ring 103 is contained in that O-ring groove. A reduced diameter integral elongated cylindrical rod having a male thread at its lower end extends downwardly from the upper end of the piston and rod assembly 102.

The rod end gland 104 of the double acting hydraulic cylinder 42 is an axially short right circular annular disk having a straight bore with a female O-ring groove containing O-ring 106.

The outer cylindrical surface of the rod end gland 104 has a male thread at its lower end and a male O-ring groove containing O-ring 105 located in a reduced diameter upper cylindrical section. The male thread of rod gland 104 is threadedly engaged with the threads at the lower end of the bore of the body 101.

The bore of rod gland 104 is a close fit to the rod of the piston and rod assembly 102. The O-ring 106 seals between the rod of the piston and rod assembly 102. A clevis 107 having an elongated throat is threadedly attached to the male thread at the lower end of the piston and rod assembly 102. At its lower end, the clevis 107 has a pair of transverse coaxial horizontal holes penetrating the jaws of the clevis. A clevis pin 108 which extends through the clevis jaws mounts a rectangular cross-section slider 110 between the clevis jaws. The clevis pin 108 is retained in place by a pair of clevis snap rings 109 engaged in transverse grooves on the ends of the pin.

Figure 13:
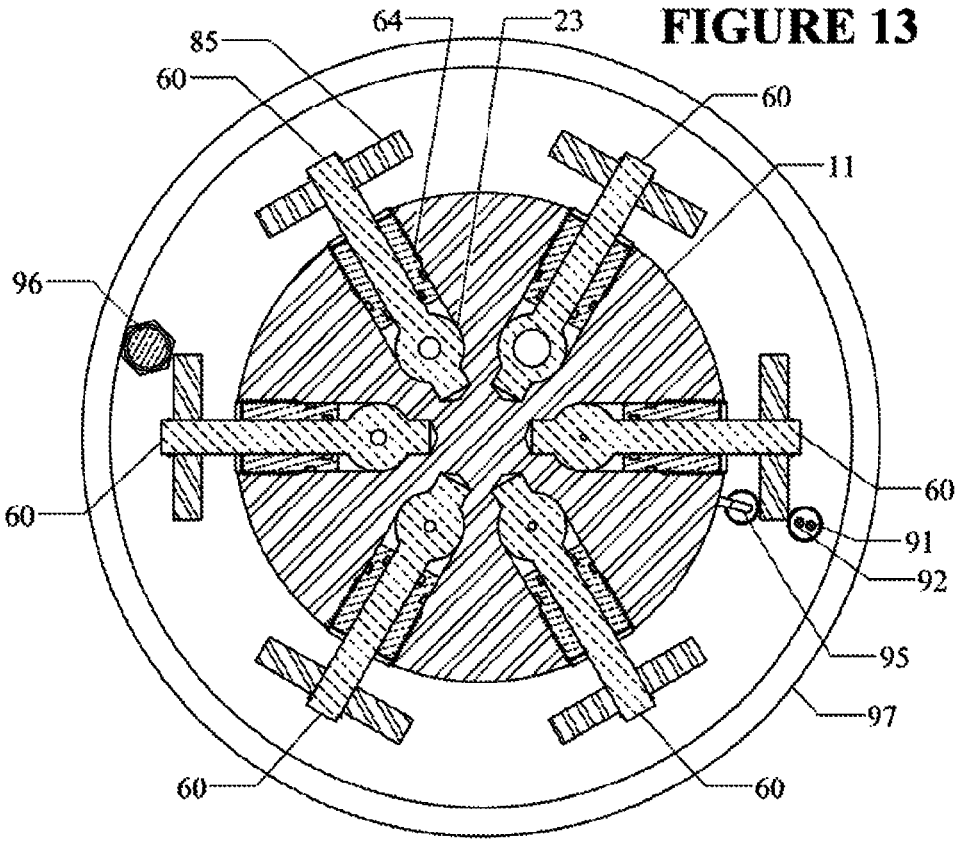
FIG. 13 is a transverse cross-sectional view taken through the combination valve assembly on the transverse centerline of the set of ball valves. All of the ball valves are shown in their open positions.
Figure 17:
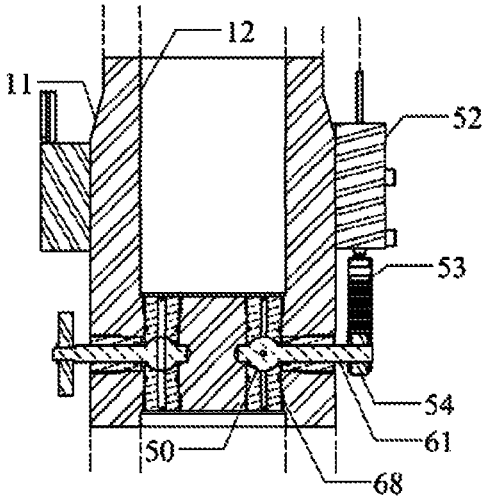
FIG. 17 is a partial longitudinal sectional view of FIG. 14 taken on Section Line 17-17.
Figure 18:
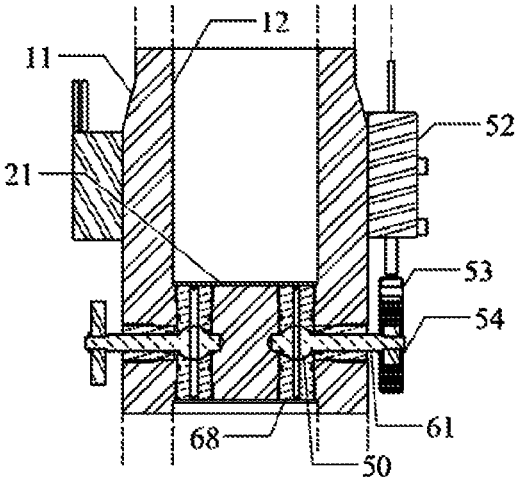
FIG. 18 is a partial longitudinal sectional view of FIG. 15 taken on Section Line 18-18.
Figure 16:
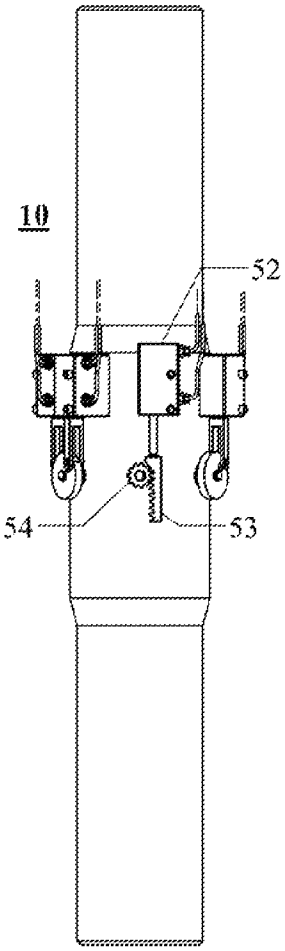
FIG. 16 corresponds to FIGS. 14 and 15, but shows the signaling valve upon completion of its stroke.
Figure 15:
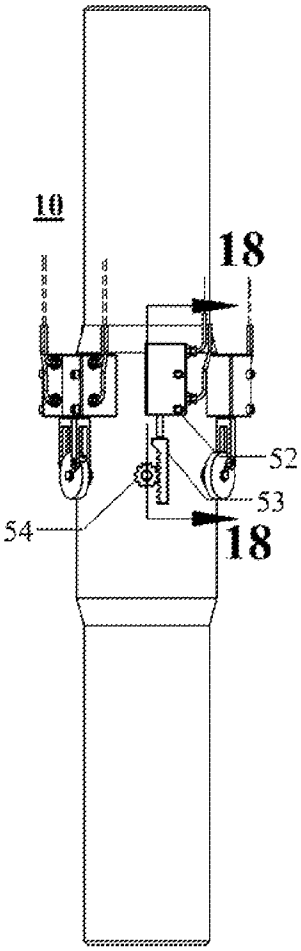
FIG. 15 corresponds to FIG. 14, but shows the signaling valve halfway through its stroke.
Figure 14:
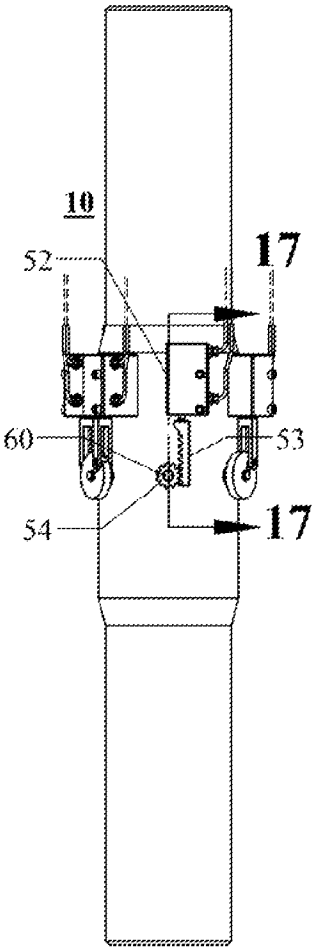
FIG. 14 is a side profile view of the combination valve taken normal to the axis of rotation of a signaling valve with a modified signaling valve actuator substituted for the conventional valve actuator cylinder arrangement. The signaling valve is shown before it is stroked.

As seen in FIG. 13, six similar ball valve assemblies 60 are mounted in the radial valve mounting bores 22 of the body 11 of the combination valve 10. The only differences between the individual ball valve assemblies are the diametrical through flow passage 62 sizes cut transverse to the axis of each ball valve 61 in the middle of the spherical portion of each ball valve. Each ball valve assembly 60 has a ball valve 61, a pair of axially opposed valve seats 68, a stem seal assembly 75, and a camming disk 85 retained by a male snap ring 88.

As seen in FIGS. 4, 5, and 6, a hall valve 61 of a ball valve assembly 60 has a spherical sealing body having a diametric through hole which serves as a flow passage 62. Extending a short distance on a diameter of the spherical portion of the ball valve 61 which is perpendicular to the flow passage 62 is a right circular cylindrical inner stem 63. The inner stem has a close slip fit to the reduced diameter interior end 24 of a radial mounting bore 22 of the body 11 of the combination valve 10.

An elongated larger diameter right circular cylindrical outer stem 64 extends in the opposite direction but on the same diameter as does the inner stem 63. The inner stem 63 and the outer stem 64 serve as axles about which the ball valve 61 can be reversibly rotated between its open and closed positions. At its distal end, the outer stem 64 has a pair of diametrically opposed camming flats 65 parallel to the axis of the outer stem. A concentric snap ring groove 66 is spaced slightly inwardly from the distal end of the outer stem 64.

The two identical valve seats 68 used with each ball valve assembly 60 are tubular right circular cylindrical structures. Each pair of seats 68 has a straight through bore flow passage 69 having the same diameter as the flow passage 62 of the ball valve 61 with which those seats are used. FIGS. 4, 5, and 6 show the outer cylindrical surface of a seat 68 to have a male threaded outer end and a reduced diameter inner end with an intermediate transverse male O-ring groove 71 containing an O-ring 72 and a backup ring 73.

At its inner end, the seat 68 has a spherical recess having the same diameter as the spherical portion of a ball valve 61. Each valve seat 68 is lapped to the spherical portion of its ball valve 61 to ensure sealing contact between the two. At its outer end, a transverse diametrical slot provides engagement for a tool for threadedly engaging the seat 68 into the threaded portion of an off axis valve seat mounting bore 23.

A stem seal assembly 75, shown in FIGS. 4, 5, and 6, retains the ball valve 61 in position in the body 11 and seals against leakage past the outer stem 64 of the ball valve. The stem seal body 76 is a right circular cylindrical tube having a through hole 77 which is a close fit to the outer stem 64 of the ball valve 61. Female O-ring groove 79 housing female O-ring 80 and backup ring 81 is located near the inner end of the stem seal body 76.

On its external cylindrical side, the stem seal body 76 has a constant diameter cylindrical section on its inner end with an intermediate male O-ring groove 78. Male O-ring 82 and backup ring 83 are mounted in O-ring groove 78. The outer cylindrical surface of the stem seal body 76 has an enlarged male threaded section to permit threadedly engaging the stem seal assembly 75 in a radial mounting bore 22 of the body 11. The transverse outer end of the stem seal body 76 has a diametrical screwdriver slot 84 to permit easy installation and extraction.

The camming disk 85, best seen in FIG. 4, is a right circular disk having a diameter several times larger than its thickness and a radial camming slot 87 with parallel sides. The camming slot 87 penetrates through the thickness of the disk 85 with its inner end spaced outwardly from the central mounting hole in the disk.

The central mounting hole 86 of camming disk 85 penetrates through the camming disk 85 and has two opposed spaced apart flats connected with diametrically opposed circular arcuate ends. The central mounting hole 86 has a close fit to the flatted outer end of the outer stem 64 of the ball valve assembly 60. The camming slot 87 is inclined at 45° to the parallel flats of the mounting hole 86. When the camming disk 85 is installed on the outer stem 64 of the ball valve, it is retained by a snap ring 88 in the snap ring groove 66 of the outer stem.

The intent of the design of the combination pressure reducing and signaling valve 10 is to provide a means of controlling pressure drops across the valve 10 by adjusting the flow through the set of ball valve assemblies 60 in a binary digital fashion. This can be achieved by sizing the flow passages 62 of the series of individual ball valve assemblies 60 so each ball valve will flow twice what its predecessor in the series of ball valves flows. By this arrangement, the combined flow of the full set of N open ball valve assemblies 60 will be $[(2)^N-1]$Qsmallest, where Qsmallest is the flow rate through the smallest of the flow passages 62 of the ball valves 61. In the arrangement of the ball valves shown herein, Qsmallest is determined for the smallest orfice ball valve assembly 40 (see FIG. 12) at the desired pressure drop.

The flow capacity of each of the ball valves is determined by the diameter of the transverse cylindrical flow passage 62 through the spherical central portion of the plug of the ball valve 61. Formulas for flow rates at a given pressure differential as a function of hole diameter are available in "The Rheology of Oil-Well Drilling Fluids", American Petroleum Institute Bulletin 13D First Edition, Dallas, Tex., August 1980. These formulas are suitable for flow restrictions such as the nozzles of drill bits and also the ball valve assemblies 60 of the present invention. In particular, formula A.15 "Friction Loss in Bit Nozzles" is utilized for sizing the flow passages 62 of the individual valves.

The flow passages 62 of the individual ball valves 61 of the present invention are sized in the following manner. The flow passage 62 for the ball valve 40 is the smallest of the six ball valves in the illustrated embodiment of in the combination valve 10. A desired operating pressure drop Δ for a maximum flow Q is selected. With all six of the ball valve assemblies 40, 45, 46, 47, 48, and 49 open, the combined flow rate is Q, and the individual flow rates are, respectively, Q/63=Qsmallest, 2Q/63, 4Q/63, 8Q/63, 16Q/63, and 32Q/63. By using different combinations of open and closed valves, any flow rate between and inclusive of zero and Q can be obtained in steps of Q/63.

It is desirable to have a means for relaying telemetered mudpulse signals across the barrier imposed by the transverse bulkhead 21 of the body 11 of the valve. Mudpulse data transmissions consist of a series of strong but not severe water hammer pulses generated in the bore of a drillstring. Such pulses can be sent upwardly from a tool at the lower end of the drillstring or downwardly from a tool at the upper end of the drillstring. If a mud pulse signal from below the tool is measured by the lower pressure sensor 93 and transmitted to the control module 97 by data cable 95, the signal can then be recorded there. A similar situation exists for a downwardly traveling mudpulse signal measured by the upper pressure sensor 90 and transmitted to the control module 97 by data cable 92.

Two possible ways exist for relaying mudpulse signals past the bulkhead 21 of the combination valve 10. The first involves quickly cycling a preselected valve 60 of the set of ball valves in the combination valve 10. The choice of which of the six valves 61 to be used for controlling the flow through the combination valve is arbitrary. This choice is governed in part by spatial considerations and in part by the desired accuracy of control. With six valves 61 controlling the flow as shown in the illustrated embodiment, a flow or pressure accuracy on the order of +/−1.5 percent is possible.

If there is no more room for a separate, dedicated signaling valve, then a single valve of the overall set of ball valves 61 can be used for signaling with its conventional actuator cylinder 42 arrangement. The particular valve 60 used in this case would be chosen in order to ensure that any water hammer caused by its rapid opening and closing would be detectable by standard pressure sensors at either end of the drillstring.

A second method of actuating a particular valve 60 would be to use a dedicated signaling valve 50 having a special double acting signaling valve hydraulic cylinder actuator 52. The ball valve assembly 60 could be identical to that used for the pressure reducing valve system, but with its camming disk 85 replaced by a signaling valve spur gear 54 as shown in FIGS. 14 to 18.

The double acting signaling valve hydraulic cylinder actuator 52 is substantially identical to the regular double acting hydraulic cylinders 42 used to operate the pressure reducing valve system, with the exception that it has a longer stroke and its clevis is replaced by a signaling gear drive rack 53. The teeth of the signaling gear drive rack 53 are in a vertical array and are engaged with the signaling valve spur gear 54 mounted on the outer stem 64 of the ball valve 61 of the dedicated signaling valve 50.

For a dedicated signaling valve 50 that transmits positive pressure pulses uphole and negative pulses downhole, the signaling valve 61 is open when the piston of its double acting signaling valve hydraulic cylinder 52 is fully retracted or extended. The valve 61 closes at the midstroke of the signaling valve hydraulic cylinder 52. In the case of a signaling valve 50 that transmits negative pressure pulses uphole and positive pulses downhole, the signaling valve 61 is closed when the piston of its double acting signaling valve hydraulic cylinder 52 is fully retracted or extended. The valve 61 opens at the midstroke of the signaling valve hydraulic cylinder 52.

Operation of the Invention

The drillstring combination pressure reducing and signaling valve 10 is typically run in the portion of the drillstring which remains in the marine drilling riser during use. This is necessitated in part by the large outer diameter of the device.

The arrangement of the embodiment of the combination pressure reducing and signaling valve 10 described above enables selection of a close approximation to a desired flow rate at a given pressure drop across the combination valve 10. Alternatively, at a given flow rate, a close approximation of a desired pressure drop can be obtained. In both cases, this can be done by varying the combination of open and closed ball valve assemblies 60. There are limits imposed by pump flow capacities and the maximum allowable size of the spherical portions of the ball valves 61, as that in turn limits the size of the maximum flow passages through the ball valve.

The sizing of the combination of orifices for the ball valves 61 is done in a manner similar to that used to size drill bit nozzles. The same formulas in the reference mentioned previously for pressure drops as a function of orifice flow rates are used in both cases.

The memory of the control module 97 is preprogrammed with a suitable coded algorithm in order to select appropriate combinations of open and closed ball valve assemblies 60 for a variety of operating conditions. The differential pressure across the transverse bulkhead 21 of the body 11, as measured by the upper 90 and lower 93 pressure sensors, is determined by the control module and used for selecting the correct valve positions.

Based upon the instructions issued by the control module 97 to the individual solenoid valves 41, those valves are activated to cause their associated hydraulic cylinders 42 to either open or close the individual ball valves 40, 45, 46, 47, 48, and 49. The pressure differential is again measured and further adjustments in the various valve 61 positions are made as necessary in order to maintain the desired flow and pressure drop combinations.

The standard actuating hydraulic cylinder 42 of a selected valve 61 could be rapidly cycled from open to closed and back to open in a predetermined sequence to produce a positive pulse signal traveling upwardly and a negative pulse signal traveling downwardly. This type of operation would require a sufficiently rapid bidirectional response of the hydraulic control valve 41 and the double acting hydraulic valve actuator cylinder 42 in order to get a sharp rise and fall time for the pressure signal. If it is desired to produce negative pulses traveling upwardly and positive pulses downwardly, then the valve would be started from a closed position, rapidly opened, and reclosed. This approach requires rapid actuator travel reversal.

If the dedicated signaling valve shown in FIGS. 14 to 18 is used, the rack 53 of the actuating cylinder 52 is sufficiently long that a full stroke of the piston of cylinder 52 produces a full 180° rotation of the valve 50. In that case, the actuating cylinder only reverses when another signaling pulse is required. If an upwardly traveling positive pulse is required, then the signaling valve 50 is open at the start and end of the stroke of the actuating cylinder 52. If an upwardly traveling negative pulse is required, then the signaling valve 50 is closed at the start and end of the stroke of actuator 52.

When the second embodiment of the signaling valve 50 with the spur gear and gear rack is used, the ball valve 60 of the system can be used with an actuating hydraulic cylinder having a rod position sensor. Feedback from such a sensor can be used selectably to stop the actuator cylinder 52 at half stroke. In such a case, the ball selectably can be left in its intermediate position, either open or closed, as well as in its positions at either ends of its stroke. This permits the signaling valve 50 to be used to provide an additional flow path for drilling fluid when not being used for signaling.

Advantages of the Invention

The use of the set of binary digital pressure reducing valves of the present invention permits the device to reduce the static pressure of the down flowing drilling mud column in the drillstring at the seabed below what would be the mud hydrostatic pressure at the seabed without use of the present invention. This permits marine drillers to use fewer casings in a given well than with the conventional approach. The pressure reducing and signaling valve system disclosed herein offers the long service life required for use in a drillstring circulating abrasive drilling mud. That long life is difficult or impossible to obtain with conventional pressure reducing valves.

The ability of the combined pressure reducing and signaling valve of the present invention to relay mudpulse transmissions bidirectionally is important with the modern drilling systems in typical offshore use. Because of the characteristics of the signaling valves of either of the two approaches described herein when used to relay mud pulse data, the bidirectionality of the relayed pulses permits the originating mudpulse device to receive confirmation of the transmission of its signal. The second signaling valve stem shown in FIGS. 14 to 18 is able to produce sharper pulses than the first described system shown in FIGS. 1 to 13.

As may be readily recognized by those skilled in the art, minor changes to the apparatus of the present invention may be made without departing from the spirit of the invention.

What is claimed is:

1. A drillstring valve assembly for operation in a fluid filled drillstring, including:

a) a tubular body of the drillstring valve assembly having a transverse diaphragm 5 with multiple through ports;

b) a series of ball valves, wherein each ball valve is centrally mounted in a diaphragm through port and wherein each ball valve is rotationally supported by a shaft and has a flow passage bore of a different size from the other valves;

c) a signaling valve centrally mounted in one diaphragm through port;

d) an independent actuator for each ball valve and the signaling valve;

e) a first and second pressure sensor, wherein the first and second pressure sensors are positioned on opposed sides of the diaphragm; and f) a programmable control unit, wherein the control unit communicates operating instructions to each actuator based on a set of pressure data received by the control unit from the first and second pressure sensors.

2. The drillstring valve assembly of claim 1, further including a power source for operating the first and second pressure sensors, the actuators and the control unit.

3. The drillstring valve assembly of claim 1, wherein the flow passage bores of the ball valves are sequentially sized so that a bore diameter of each ball valve in the series is equal to the bore diameter of the preceding ball valve multiplied by a constant factor greater than 1.0.

4. The drillstring valve assembly of claim 1, wherein each ball valve and the signaling valve are bidirectionally rotationally movable between a fully open position and a fully closed position.

5. The drillstring valve assembly of claim 1, wherein each ball valve and the signaling valve are mounted in parallel and are independently operable.

6. The drillstring valve assembly of claim 1, wherein the actuator for each ball valve is a two position linear actuator that is mounted on an exterior surface of the body and is eccentrically connected to the shaft of one ball valve, wherein said shaft extends through a radial valve mounting bore that intersects an axis of one through port at a mid-length of said through port.

7. The drillstring valve assembly of claim 1, wherein the opening and closing of the signaling valve produces a negative pressure pulse traveling upwardly and a positive pressure pulse traveling downwardly.

8. The drillstring valve assembly of claim 1, wherein the closing and opening of the signaling valve produces a negative pressure pulse traveling downwardly and a positive pressure pulse traveling upwardly.

9. The drillstring of valve assembly of claim 1, wherein the signaling valve has a bore diameter that is larger than the diameter of the ball valve bore having the smallest bore.

10. A drillstring valve assembly including:

a) a tubular body of the drillstring valve assembly having a transverse diaphragm with multiple through ports, wherein the body is connected to a drillstring within a central portion along a length of the drillstring;

b) a series of two position independently operable 5 ball valves, wherein each ball valve is centrally mounted in a diaphragm through port and wherein each ball valve has a different flow capacity at a given pressure from the other valves;

c) a first and second pressure sensor, wherein the first and second pressure sensors are positioned on opposed sides of the diaphragm;

d) an independent signaling valve centrally mounted in one diaphragm through port, wherein a flow capacity of the signaling valve at the given pressure is greater than at least one of the ball valves and wherein the rapid opening and closing of the signaling valve produces and relays a pressure pulse through the diaphragm;

e) an actuator for each ball valve and the signaling valve; and f) a programmable control unit in communication with the first and second pressure sensors, wherein the control unit determines a pressure differential across the diaphragm and whenever the pressure differential across the diaphragm is greater than a desired pressure differential the control unit sends operating instructions to at least one actuator of one of the ball valves to open or close the ball valve.

11. The drillstring valve assembly of claim 10, wherein a flow passage bore of the ball valves are sequentially sized so that at a given pressure differential across the diaphragm, a first ball valve in the series flows one unit of flow and with the same pressure differential each succeeding valve in the series flows twice the number of units of flow as a preceding ball valve in the series.

12. The drillstring valve assembly of claim 11, wherein the signaling valve flows more than one unit of flow at the given pressure differential across the diaphragm.

13. The drillstring valve assembly of claim 10, wherein whenever the first or second pressure sensor detects a sequence of communication pr 5 pressure pulses the control unit instructs the signaling valve to relay the sequence of pressure pulses across the diaphragm.

14. The drillstring valve assembly of claim 13, wherein the signaling valve relays the sequence of communication pressure pulses by opening and closing, wherein the opening of the signaling valve produces an upwardly traveling negative pressure pulse on an upper side of the diaphragm and a simultaneous downwardly traveling positive pulse on a lower side of the diaphragm.

15. The drillstring valve assembly of claim 10, wherein the ball valves and the signaling valve are mounted in parallel.

16. A drillstring of valve assembly comprising:

(a) a tubular body having a central transverse diaphragm, wherein the body is connected to a drillstring within a central portion along a length of the drillstring;

(b) an ordered sequence of multiple actuated two position ball valves mounted in the diaphragm such that each valve is individually mounted in a through port in the diaphragm such that a flow passage of each valve is selectably opened or closed, wherein each valve has a different flow capacity at a given pressure drop, said flow capacities of the individual valves doubling with progression through the sequence;

(c) an upper pressure sensor positioned above the diaphragm and a lower pressure sensor positioned below the diaphragm;

(d) a signaling valve centrally mounted in one diaphragm through port, wherein a flow capacity of the signaling valve at the given pressure drop is greater than at least one of the ball valves and wherein the rapid opening 5 and closing of the signaling valve produces and transmits pressure pulses propagating bidirectionally away from the diaphragm;

e) an actuator for each ball valve and the signaling valve; and f) a programmable control unit in communication with the upper and lower pressure sensors, the ball valves and the signaling valve, wherein the control unit receives all pressure measurements from the upper and lower pressure sensors, controls the opening and closing of the signaling valve, processes all pressure pulses transmitted from the diaphragm and sends operating instructions to open or close at least one of the ball valves.

17. A method of transmitting a pressure pulse signal including:

a) maintaining a pressure differential across a diaphragm mounted transversely across a drillstring;

b) sensing a pressure pulse signal on a first side of the diaphragm, c) opening and closing a signaling valve controlling a flow passage through the diaphragm, thereby producing and transmitting an outgoing pressure pulse on the opposed side of the barrier; and d) opening or closing one or more of an array of pressure reducing ball valves mounted in parallel in the diaphragm, wherein each opened ball valve has a different flow capacity through the diaphragm at a given pressure drop, thereby producing the desired pressure differential across the diaphragm at a given combined flow rate through the open ball valves to control the pressure differential across the diaphragm.

* * * * *